US005423611A

United States Patent [19]

Sherrard

[11] Patent Number: 5,423,611

[45] Date of Patent: Jun. 13, 1995

[54] REINFORCED BAG-LIKE CONTAINER

[76] Inventor: Dale D. Sherrard, 34125 Sherrard La., Charlotte, Me. 04666-34125

[21] Appl. No.: 231,805

[22] Filed: Apr. 25, 1994

[51] Int. Cl.[6] ..... B65D 30/16

[52] U.S. Cl. ..... 383/24; 383/67; 383/107; 383/119; 220/460; 220/464

[58] Field of Search ..... 383/24, 41, 67, 119, 383/109, 107; 220/460, 461, 464

[56] References Cited

U.S. PATENT DOCUMENTS

| | | | |
|---|---|---|---|
| 4,362,199 | 12/1982 | Futerman | 383/119 X |
| 4,759,473 | 7/1988 | Derby et al. | 383/24 X |
| 4,903,859 | 2/1990 | Derby et al. | 383/119 X |
| 5,158,369 | 10/1992 | Derby | 383/119 X |
| 5,323,922 | 6/1994 | Lapoint, Jr. et al. | 383/119 X |

FOREIGN PATENT DOCUMENTS

| | | | |
|---|---|---|---|
| 2824940 | 12/1979 | Germany | 383/24 |

*Primary Examiner*—Allan N. Shoap
*Assistant Examiner*—Jes F. Pascua
*Attorney, Agent, or Firm*—Frederick R. Cantor

[57] ABSTRACT

A double wall container of bag-like character includes a two layer U-shaped wall structure forming the bottom wall and two side walls of the container. Two double layer panels are stitched to edge areas of the U-shaped wall structure to complete the container. Edge areas of the panel and wall structure are reversely turned inwardly to form double thickness edges stitchable together to provide reinforced container corners. The fabric container is rigidified by means of four stiffener boards, or plates, insertable into pockets formed by the double layer side walls of the container.

8 Claims, 3 Drawing Sheets

REINFORCED BAG-LIKE CONTAINER

BACKGROUND OF THE PRESENT INVENTION

1. Field of the Invention

The present invention relates to a bag-like container.

The present invention relates to a bag-like container, more particularly, for transporting particulate or flowable materials. One particular usage of the present invention is the transporting of fish packed in ice from areas where the fish are caught, to canneries, or fish distribution areas.

2. Prior Developments

Historically, fish have been transported in rigid containers, with cracked ice being packed in and around the fish for preservation purposes. Often the container walls are insulated to minimize thermal flow into the container.

One problem with such containers is their relatively high cost. Typically a cube-like rigid container measuring four feet on a side, will cost upwards of four hundred ($400.00) dollars.

Double-walled flexible bag-like containers have been proposed for transporting bulk materials, such as fluidized solids, slurries, liquids, granular materials, and particulates of various types. Such flexible bag-like containers are rigidified against undesired collapse by inserting rigid boards, or panels, in the spaces formed between the inner and outer layers of the double walls. The rigid boards may also be removed for shipping the bag-like containers empty and collapsed.

These double-walled flexible containers are relatively inexpensive, and offer a further advantage of being readily collapsed into a small volume when empty, so as to be transportable at relatively small expense. At least three U.S. patents have been issued on variations of such double-walled flexible containers.

U.S. Pat. No. 4,903,859, issued to N. Derby et al., on Feb. 27, 1990, discloses a container for fluidized solids, slurries and liquids, wherein the container side walls are formed of spaced layers of a flexible material, such as woven polypropylene. Rigid panels are inserted into the spaces between the layers of flexible material, whereby the container is rigidified against undesired collapse when filled with fluid material.

U.S. Pat. No. 5,185,369, issued to N. Derby on Oct. 27, 1992, discloses a bag-like container that is generally similar to the container shown in the Derby U.S. Pat. No. 4,903,859. The container has a top wall, and a tubular filler spout projecting upwardly from the top wall. Lifter loops are provided at the four corners along the container upper edge. Rigidifying panels are removably disposed in the container side walls, and each panel is retained by means of a pocket-forming flap in the lower edge of the bag side wall. The bottom wall of the container may be reinforced by providing a flat tray underneath the container.

U.S. Pat. No. 5,209,364, issued to John Lapoint on May 11, 1993, discloses a container having fabric walls and an open top. Each fabric side wall is of double layer construction that forms an upwardly-open pocket for containment of a rigidifying panel. The inner fabric layers of the container side walls extend upwardly to form a filler spout for fluent materials. The container has lifter loops at its upper corners, and a removable cover.

SUMMARY OF THE PRESENT INVENTION

An object of the present invention is to provide a bag-like container.

An object of the present invention is to provide a bag-like container, having double layer side walls for removably accommodating rigidifying panels or boards, whereby the container is self-supporting when filled with flowable particulate material, e.g., a mixture of fish and cracked ice, etc.

The bag-like container is comprised of a flexible U-shaped wall structure that forms the bottom wall and two side walls of the container. The container further comprises two essentially square flexible panels that form the remaining two sides of the container.

The U-shaped wall structure and the square panels are of double layer construction that define pockets for accommodating stiffener panels or boards. The panels can be removed for reducing the container volume, e.g., when it is desired to ship an empty container back to an origination point for refilling and reshipment.

A principal feature of the present invention is that edge areas of the U-shaped wall structure and the square panels are turned or folded reversely inwardly to form double thickness edges. The double thickness edges on the U-shaped wall structure and the square panels are mated together, and stitched therealong, to form a relatively high strength flexible container.

Lifter straps are provided at the four vertical corners of the container. Each lifter strap extends downwardly between the double thickness edges on the U-shaped wall structure and associated flexible panels, such that a portion of the stitching through the double thickness edges, is effective to secure the lifter straps to the container.

A principal aim of the present invention is to provide a flexible double-walled container having high strength connections between the container walls, whereby the container is enabled to carry relatively heavy loads without premature failure.

In summary, and in accordance with the above discussion, the foregoing objectives are achieved in the following embodiments.

1. A collapsible container for particulate material, comprising a flexible U-shaped wall structure and two flexible panels;

said U-shaped wall structure comprising an inner wall member and an outer wall member secured together to form two double layer side walls and a double layer bottom wall;

each flexible panel comprising an inner panel member and an outer panel member secured together to form a double layer side wall;

the inner wall member of said U-shaped wall structure having side edge areas thereof turned reversely inwardly to form double thickness edges on the defined side walls and bottom wall;

the inner panel member of each flexible panel having three side edge areas thereof turned reversely inwardly to form double thickness edges;

the double thickness edges on said flexible panels being in facial engagement with the double thickness edges on said U-shaped wall structure;

stitching extending through said facially engaged double thickness edges whereby said U-shaped wall structure and said flexible panels collectively form a five-sided flexible container having four vertical corners;

lifter straps secured to said flexible container at said vertical corners;

each lifter strap having a loop configuration;

each lifter strap comprising mated strap walls extending downwardly between double thickness edges on the U-shaped wall structure and an associated flexible panel, whereby the straps are affixed to the flexible container by the aforementioned stitching;

each said double layer side wall defining an upwardly open pocket spanning the associated double thickness edges; and a relatively rigid board positionable in each pocket for rigidifying the container against collapse.

2. The collapsible container, as described in paragraph 1, said inner wall members and said inner panel members having upper edges located in a first horizontal plane spaced above a second horizontal plane defined by the upper edges of the associated outer wall members and outer panel members; and a reinforcement band extending along said inner wall members and inner panel members in the zone between said first and second horizontal planes.

3. The collapsible container, as described in paragraph 1, said inner wall members and said inner panel members having upper edges thereof located in a common horizontal plane; a flexible tubular cover attached to said inner wall members and said inner panel members at said horizontal plane; and said tubular cover being extendable upwardly from the container to form a loading chute.

4. The collapsible container, as described in paragraph 3, and further comprising a reinforcement band extending along side inner wall members and inner panel members in the zone directly below said horizontal plane.

5. The collapsible container, as described in paragraph 1, and further comprising a flexible tubular discharge chute extendable downwardly from said double layer bottom wall.

6. The collapsible container, as described in paragraph 5, wherein said double layer bottom wall has an opening therein; and said discharge chute having a channel cross-sectioned upper mouth fitting onto the edge of said opening to attach the discharge chute to said double layer bottom wall.

7. The collapsible container, as described in paragraph 6, and further comprising second stitching extending transversely through said channel cross-sectioned mouth and the edge of the opening in said double layer bottom wall.

8. The collapsible container, as described in paragraph 5, and further comprising a sack-like liner removably fitting within the space circumscribed by the container walls; and said liner being formed of a flexible plastic material capable of being punctured, whereby particulate material is dischargeable through the discharge spout after said liner has been punctured.

A BRIEF DESCRIPTION OF THE DRAWINGS

FIG. 5, illustrates the connection between a lifter strap and the container corner structure.

DESCRIPTION OF THE PREFERRED EMBODIMENTS OF THE PRESENT INVENTION

Figure 1:
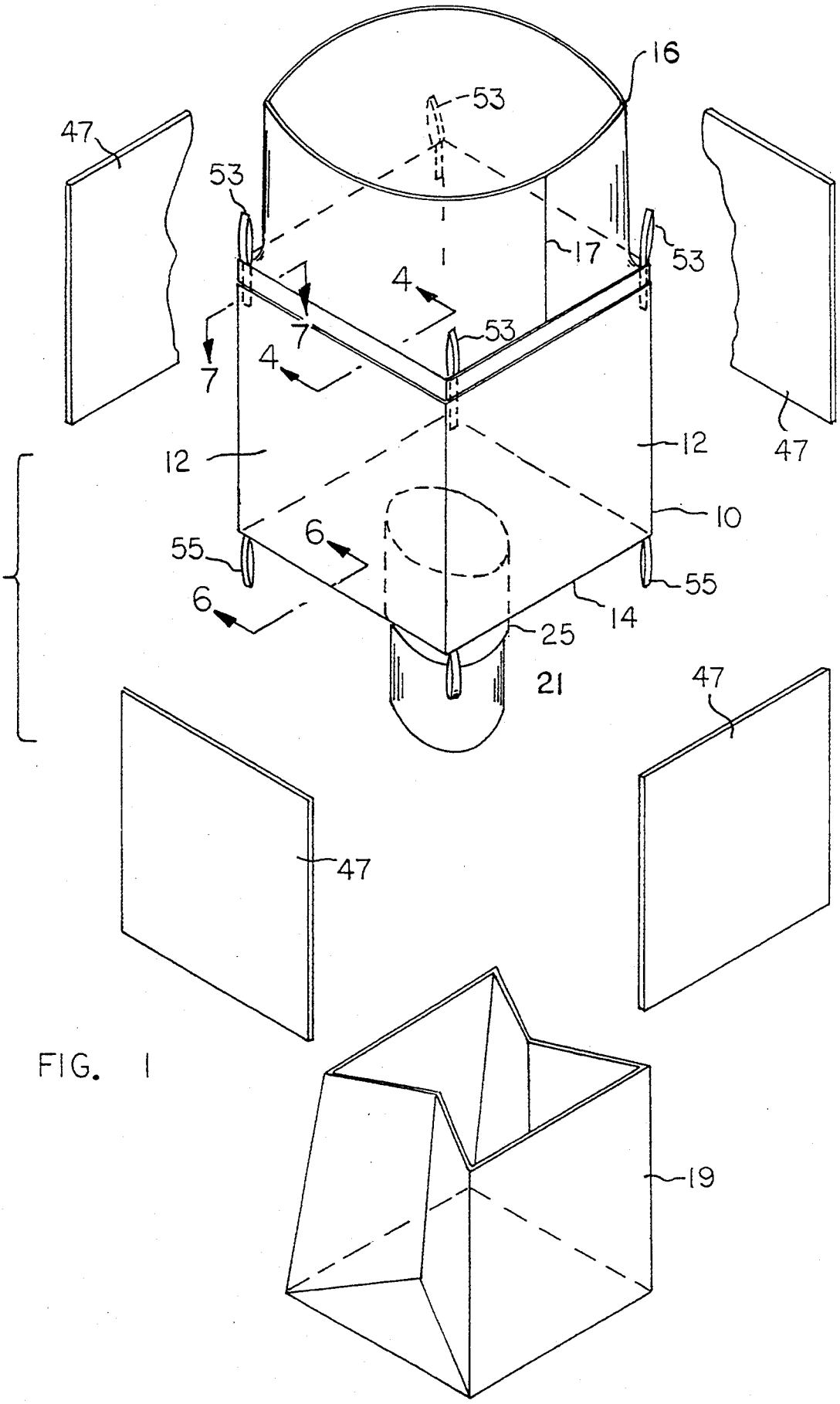
FIG. 1, is a perspective view, of a flexible bag-like container embodying the present invention. Rigidifying boards and a sack-like liner are shown removed from the container.

FIG. 1, is a perspective view, of a flexible bag-like container embodying the present invention. Rigidifying boards and a sack-like liner are shown removed from the container.

Figure 2:
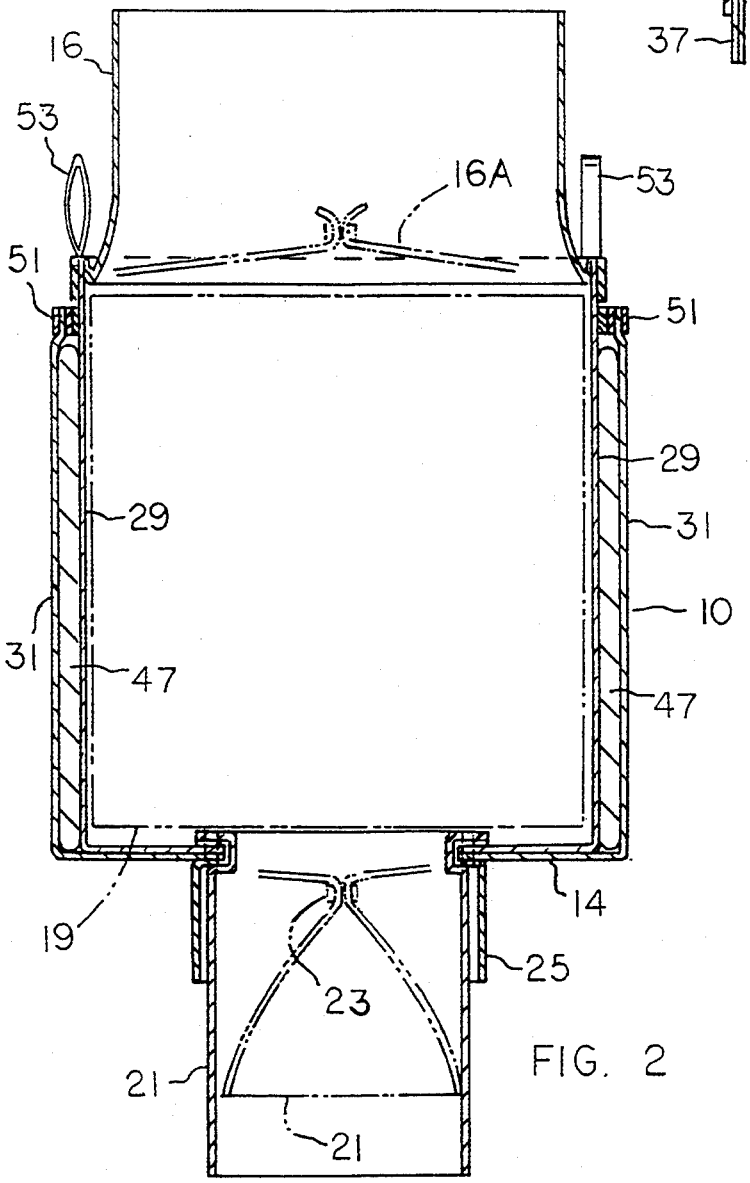
FIG. 2, is a longitudinal sectional view, taken through the container depicted in FIG. 1.

FIG. 2, is a longitudinal sectional view, taken through the container depicted in FIG. 1.

Referring particularly to FIG. 1, there is shown a container 10, having four upstanding side walls 12 and a bottom wall 14. A flexible tubular cover 16, is attached to the upper edges of the container side walls 12. The cover 16, extends upwardly from the container 10, for a limited distance, e.g., thirty inches. The upper end of the tubular cover 10, is open for admission of flowable materials, e.g., a fish and ice mixture, into the container.

Cover 16, is formed of a flexible material, e.g., woven polypropylene. Woven polypropylene is commercially available from Amoco Corporation. A flat woven sheet is formed into a tubular shape and stitched along the connecting seam line 17. The lower edge of the tubular cover 16, is stitched to the upper edges of the container side walls 12.

Cover 16, forms a loading chute for accommodating downflow of flowable material into the container 10. The upper edge area of the tubular cover 16, can be clamped, or otherwise temporarily secured, to a non-illustrated spout depending from a supply box for the flowable material. As previously noted, the flowable material can be fish mixed with cracked ice, in random fashion or in layers.

After the fish-ice mixture has been loaded into the container 10, the flexible cover 16, is collapsed and folded down onto the container 10, to overlie the materials in the container. The upper mouth area of the cover 16, is closed by tying a rope, cable, or similar tie element, around the cover material. Numeral 16A, in FIG. 2, illustrates generally the condition of the cover 16, in its collapsed condition.

In preferred practice of the invention, the fish-ice mixture is contained within a plastic liner removably disposed in the container 10. Numeral 19, in FIG. 1, references a plastic liner of sack-like configuration, that can be used for containment of the fish and ice mixture. The sack-like liner 19, can be of four mil plastic sheet material, creased along its corners in a fashion similar to creasing procedures used for conventional paper sacks used for containment of groceries. The sack-like plastic liner 19, is disposable and usable on a one-time basis. It is inserted into container 10, prior to the operation of down-loading the fish-ice mixture into the container 10. The plastic liner 19, receives the fish-ice mixture, and isolates the fabric walls of container 10, from direct contact with the fish-ice mixture. The liner 19 serves a sanitation purpose in that it keeps the inner surface of the container walls clean and free of blood, tissue, dirt, or other contaminating materials. The plastic liner 19, conforms to the interior shape of the container 10, as shown in dashed lines in FIG. 2, such that the liner 19 is not required to support the weight of the fish-ice mixture. The liner 19 is removed and replaced with a new liner 19 after each usage (shipment) of the container 10. The upper mouth area of the plastic liner 19 can be closed with a plastic tie to prevent direct contact between cover 16, and the fish-ice mixture.

Container 10, has a discharge chute 21, extending downwardly from its bottom wall 14. At the destination point of the shipment, the plastic liner 19, is slit in the area above chute 21, whereupon the weight of the fish-ice mixture causes the mixture to be discharged through chute 21, into a non-illustrated hopper, tank or conveyor system.

During the shipment period, prior to slitting of liner 19, discharge chute 21, is closed shut by means of a strap 23 tied tightly around the chute 21 near its upper end. The closed chute 21 supports plastic liner 19, against downward collapse under the pressure of the flowable material. Chute 21, is preferably formed of a reinforced plastic sheet material, e.g., sheet materials used for swimming pool covers. The surface of the plastic sheet material should be relatively smooth and non-porous for cleaning purposes.

As an optional feature, an auxiliary tubular shroud 25, can be provided around chute 21. When chute 21, is extended downwardly into a tubular duct (not shown), shroud 25, can be telescoped onto the exterior surface of the duct to hold the chute against possible displacement out of the duct. A flexible tie element can be incorporated into the lower edge of shroud 25, to facilitate connection of the shroud 25 to the non-illustrated duct. Shroud 25, can be formed of the same material as discharge chute 21.

The present invention relates particularly to the construction of container 10. The flexible container 10 is preferably formed of a woven polypropylene fabric. One source of such a fabric sheet material is the Amoco Corporation.

Figure 3:
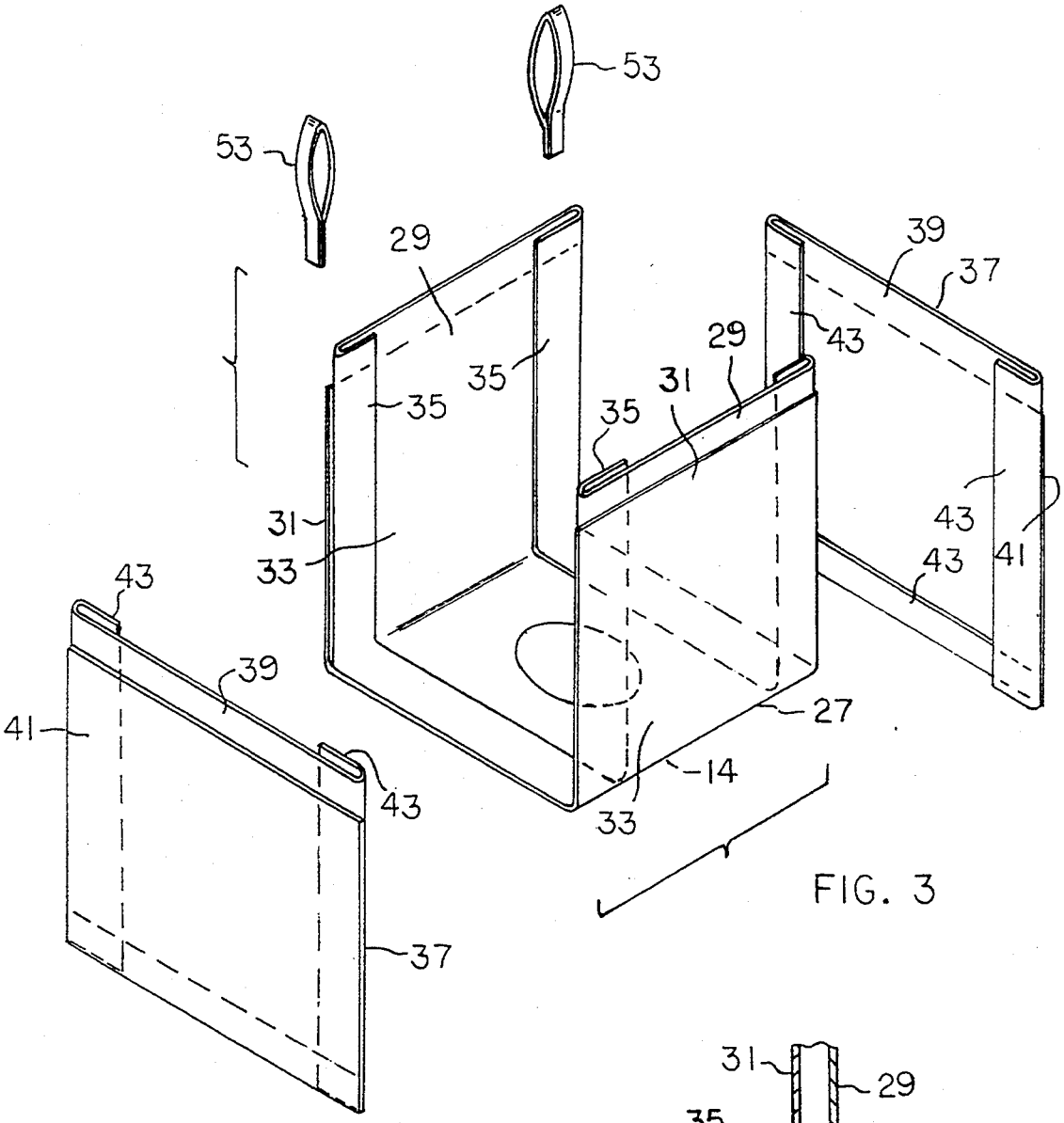
FIG. 3, is a fragmentary perspective view, of container components used to form the FIG. 1 container. The components are shown in an exploded, separated condition prior to assembly together.

FIG. 3, is a fragmentary perspective view, of container components used to form the FIG. 1 container. The components are shown in an exploded, separated condition prior to assembly together.

Referring to FIG. 3, the flexible container includes a flexible (fabric) U-shaped wall structure 27, that comprises an inner U-shaped wall member 29, and an outer U-shaped wall member 31, lying against the outer surface of the inner wall member 29. The two wall members collectively form a container bottom wall 14, and two container side walls referenced by numerals 33. Each side wall 33, corresponds to one of the previously referenced container side walls 12.

Side edges of the inner wall member 29, are turned reversely inwardly, as at 35, to form double thickness edges extending parallel to the plane of the U configuration. The fabric material may be creased and pressed to maintain the double thickness edge construction. Light stitching can be used along the side edges of wall members 29 and 31, for temporarily holding them together.

Container 10, further comprises two flexible fabric panels 37, sized to conform to the space circumscribed by the U-shaped wall structure 27. Each fabric panel 37, comprises an inner panel member 39, and an outer panel member 41. Three edge areas of each inner panel member 39, are reversely turned, as at 43, to form double thickness edges that are matable to the double thickness edges on U-shaped wall structure 27. Members 39 and 41, are formed of the same material as structure 27.

Figure 6:
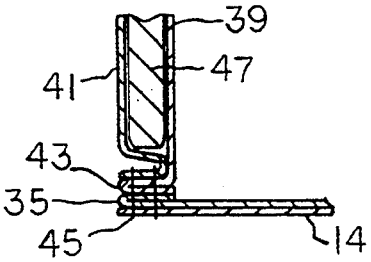
FIG. 6, is a fragmentary sectional view, taken along line 6—6 in FIG. 1.

FIG. 6, is a fragmentary sectional view, taken along line 6—6 in FIG. 1.

Figure 7:
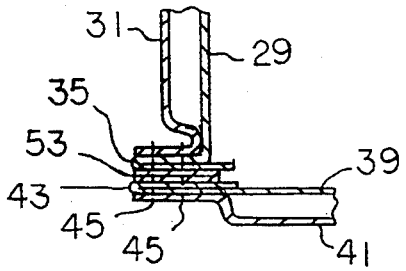
FIG. 7, is a fragmentary sectional view, taken along line 7—7 in FIG. 1.

FIG. 7, is a fragmentary sectional view, taken along line 7—7 in FIG. 1.

Figure 8:
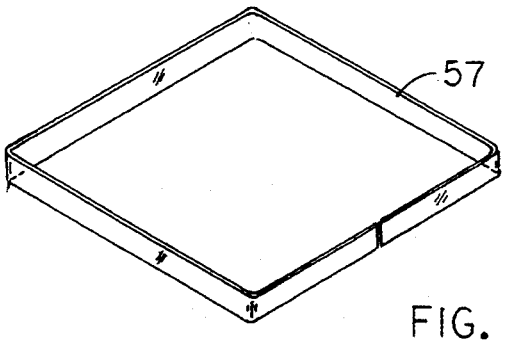
FIG. 8, is a perspective view, of a reinforcement band, or web, used in the container depicted in FIG. 2.

FIG. 8, is a perspective view of a reinforcement band or web used in the container depicted in FIG. 2.

Panels 37 are secured to wall structure 27, by heavy stitching. In the drawings, such stitching is referenced by numeral 45. Preferably at least two rows of stitches 45, are formed along the mated double thickness edges on panels 39 and U-shaped wall structure 27. Stitching 45, extends through the fabric of the inner members 29 and 39, and also the fabric of the associated outer members 31 and 41. Thus, stitching 45, acts as the primary connection means between the inner wall (panel) members and the outer wall (panel) members. Stitching 45, preferably comprises continuous rows of stitches extending along the side edges of the U-shaped wall structure 27, i.e., along the container vertical corners and along lower edges of the container.

The flexible fabric container 10, is stiffened, or rigidified, by four stiffener panels, or boards 47, insertable into pockets formed by the inner and outer members of the respective container side walls. Each stiffener board 47, can be formed of any rigid, non-brittle, material resistant to forces associated with rough handling, e.g., dropping the container 10 onto a floor surface from an elevated height, or swinging the container 10 against wall surfaces. Each stiffener panel 47, can be a rigid hollow plate structure containing a freezable liquid. The frozen liquid can contribute some cooling to the container contents, so as to augment the action of the ice in the fish-ice mixture.

Figure 4:
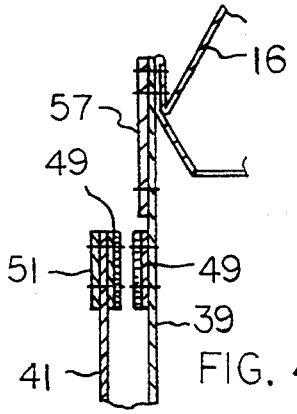
FIG. 4, is a fragmentary sectional view, taken along line 4—4 in FIG. 1.

The pocket in each container side wall has an opening along its upper edge for permitting a stiffener board to be inserted into the pocket or removed from the pocket. Each opening may be closed by two mating strips of adhesive material stitched to the inner and outer members of the respective container side wall. The adhesive strips can be formed of the fibrous hook and loop materials marketed under the tradename VELCRO. In FIGS. 2 and 4, the mating adhesive strips are shown, and in FIG. 4 are referenced by numeral 49. A reinforcement band 51, extends entirely around the container 10 at the upper edges of outer members 31 and 41, to stiffen the fabric material of outer members 31 and 41. The stitching for the outer strips 49, extends through band 51, as well as the adhesive strips. At least two rows of stitches 45 are used.

Container 10, and its contents, can weigh in excess of one ton (when the container is loaded). To facilitate transport and lifting of the loaded container, the container is provided with four lifter straps 53. Each lifter strap is formed out of a high strength web or strap material, capable of being turned into a loop configuration. One suitable loop material is the woven fabric material used for safety belts in automobiles.

Each lifter strap 53, has a loop configuration that includes mating flat lower portions extending downwardly into the space between the mating double thickness edges on the U-shaped wall structure 27, and each fabric panel 37. Some of the stitching 45 used to attach panels 37, to U-shaped wall structure 27, also serves as an attachment means for the lifter straps 53. The lifter strap anchorages are integrated into the corners of the container, such that the lifting forces are applied at the most heavily reinforced areas of the container. The strap length sandwiched between the double thickness edges of panel members 39 and wall member 29, is at least about eight (8) inches in a container having a vertical dimension of about four (4) feet. Such a strap length, provides sufficient resistance against pull out of the strap 53.

The container 10 may be lifted and transported by suspending the lifter loops (straps) 53, from a fork lift truck or from a spreader attached to an overhead hoist.

The container may be equipped with hold-down loops 55, along its lower edge at its corners. Such loops 55 can be formed of the same material as the lifter straps 53. Stitching 45 used to attach panel members 39 to wall members 29 will also incidently attach loops 53 to corner areas of the fabric container.

The upper edges of inner panel members 39 and wall members 29, extend in a horizontal plane that is slightly elevated relative to the plane of the upper edges of outer panel members 41, and wall members 31, as shown, e.g., in FIG. 4. A reinforcement band 57, extends along and around the inner members 39 and 29, in the zone above the upper edges of the outer fabric members 41 and 31.

Reinforcement band 57 may be formed of a high strength webbing material, e.g., the webbing material used for automobile seat belts. The width of the webbing may be about two inches. The webbing (band) 57, extends entirely around the container 10 periphery, including the fabric areas occupied by lifter straps 53, at the container corners. At least two rows of stitches 45 are formed through the band 57, and the fabric areas in contact with the band 57; such stitching 45 extends the entire length of the band 57. Additional stitching is provided through band 57, and the adjacent areas of lifter straps 53.

Reinforcement band 57, will be in tension when the container 10 is loaded. Band 57, acts as a tensioned hoop to contain load stresses at, or near, the upper edge of the container 10. Band 57, is anchored to the reinforced corner areas of the container, such that the load tends to be at least partially equalized between the various fabric walls.

FIG. 4, is a fragmentary sectional view, taken along line 4—4 in FIG. 1.

Figure 5:
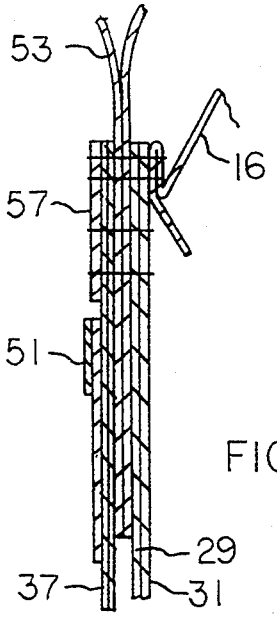
FIG. 5, is a sectional view, taken in the same direction as FIG. 4, but at a corner of the container.

FIG. 5, is a sectional view, taken in the same direction as FIG. 4, but at a corner of the container. FIG. 5, illustrates the connection between a lifter strap and the container corner structure.

Referring to FIGS. 4 and 5, there is shown an edge area of the fabric cover 16, doubled back on itself to form a double thickness edge in contact with the upper edge of the container 10. Cover 16, is attached to the container by means of the stitching 45 that extends through band 51. Cover 16, is attached to the container along the entire upper edge of the container.

Figure 9:
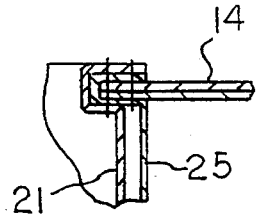
FIG. 9, is a fragmentary sectional view, on an enlarged scale, of a structural connection between a container bottom wall and a discharge chute in the FIG. 2 container.

FIG. 9, is a fragmentary sectional view, on an enlarged scale, of a structural connection between a container bottom wall and a discharge chute in the FIG. 2 container.

Referring to FIGS. 2 and 9, there is shown the upper edge of fabric chute 21, fitting around the edge of a circular opening in the double thickness bottom wall 14, of the fabric container. The chute 21 fabric at the upper end of the chute 21 has a channel cross-section fitting around the edge of the circular opening. Heavy stitching extends through the channel cross-section fabric and wall 14 fabric for attachment of the chute 21 to wall 14. The stitching comprises one or more annular rows of stitches.

The invention has, as a principal feature, a high strength connection between the double thickness fabric walls, at the container corners. The double thickness edges at 35 and 43, are stitched together to reinforce the container at its corners. Lifter straps 53, are securely attached to the reinforced corners by high strength stitching.

The outer layers of the container side walls are attached to the inner layers 29 and 39, by rows of stitches located at the extreme corners of the container. The pockets for stiffener plates 47, can therefore be relatively wide, such that the stiffener plate width is approximately the same as the container side wall width dimension. The stiffener plates 47 can thus provide a substantial stiffener action, without looseness, or flexure, of the container corners.

The present invention, described above, relates to a reinforced bag-like container. Features of the present invention are recited in the appended claims. The drawings contained herein necessary depict structural features and embodiments of the reinforced bag-like container, useful in the practice of the present invention.

However, it will be appreciated by those skilled in the arts pertaining thereto, that the present invention can be practiced in various alternate form sand configurations. Further, the previous detailed descriptions of the preferred embodiments of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. A collapsible container for particulate material, comprising a flexible U-shaped wall structure and two flexible panels;

said U-shaped wall structure comprising an inner wall member and an outer wall member secured together to form two double layer side walls and a double layer bottom wall;

each flexible panel comprising an inner panel member and an outer panel member secured together to form a double layer side wall;

the inner wall member of said U-shaped wall structure having side edge areas thereof turned reversely inwardly to form double thickness edges on the defined side walls and bottom wall;

the inner panel member of each flexible panel having three side edge areas thereof turned reversely inwardly to form double thickness edges;

the double thickness edges on said flexible panels being in facial engagement with the double thickness edges on said U-shaped wall structure;

stitching extending through said facially engaged double thickness edges whereby said U-shaped wall structure and said flexible panels collectively form a five-sided flexible container having four vertical corners;

lifter straps secured to said flexible container at said vertical corners;

each lifter strap having a loop configuration;

each lifter strap comprising mated strap walls extending downwardly between double thickness edges on the U-shaped wall structure and an associated flexible panel, whereby the straps are affixed to the flexible container by the aforementioned stitching;

each said double layer side wall defining an upwardly open pocket spanning the associated double thickness edges; and a relatively rigid board positionable in each pocket for rigidifying the container against collapse.

2. The collapsible container, as described in claim 1, said inner wall members and said inner panel members having upper edges located in a first horizontal plane spaced above a second horizontal plane defined by the upper edges of the associated outer wall members and outer panel members; and a reinforcement band extending along said inner wall members and inner panel members in the zone between said first and second horizontal planes.

3. The collapsible container, as described in claim 1, said inner wall members and said inner panel members having upper edges thereof located in a common horizontal plane; and a flexible tubular cover attached to said inner wall members and said inner panel members at said horizontal plane; and said tubular cover being extendable upwardly from the container to form a loading chute.

4. The collapsible container, as described in claim 3, and further comprising a reinforcement band extending along side inner wall members and inner panel members in the zone directly below said horizontal plane.

5. The collapsible container, as described in claim 1, and further comprising a flexible tubular discharge chute extendable downwardly from said double layer bottom wall.

6. The collapsible container, as described in claim 5, wherein said double layer bottom wall has an opening therein; and said discharge chute having a channel cross-sectioned upper mouth fitting onto the edge of said opening to attach the discharge chute to said double layer bottom wall.

7. The collapsible container, as described in claim 6, and further comprising second stitching extending transversely through said channel cross-sectioned mouth and the edge of the opening in said double layer bottom wall.

8. The collapsible container, as described in claim 5, end further comprising a sack-like liner removably fitting within the space circumscribed by the container walls; and said liner being formed of a flexible plastic material capable of being punctured, whereby particulate material is dischargeable through the discharge spout after said liner has been punctured.

* * * * *